US006048051A

United States Patent [19]

Ahn

[11] Patent Number: 6,048,051

[45] Date of Patent: Apr. 11, 2000

[54] INK-JET PRINTING METHOD AND INK-JET PRINTING APPARATUS USING DIELECTRIC MIGRATION FORCE

[75] Inventor: Byung-Sun Ahn, Kyungki-do, Rep. of Korea

[73] Assignee: SamSung Electronics Co., Ltd., Kyungki-do, Rep. of Korea

[21] Appl. No.: 08/951,643

[22] Filed: Oct. 16, 1997

[30] Foreign Application Priority Data

Oct. 16, 1996 [KR] Rep. of Korea ..... 96-46260

[51] Int. Cl.[7] ..... B41J 2/04

[52] U.S. Cl. ..... 347/54

[58] Field of Search ..... 347/54, 55, 84, 347/103, 68, 70, 71, 154, 123, 111, 159, 122, 128, 17, 141, 120, 157; 399/271, 290, 292, 293, 294, 295

[56] References Cited

FOREIGN PATENT DOCUMENTS 40-2357039 12/1992 Japan ..... 347/54

*Primary Examiner*—John Barlow
*Assistant Examiner*—Raquel Yvette Gordon
*Attorney, Agent, or Firm*—Robert E. Bushnell, Esq.

[57] ABSTRACT

An ink-jet printing method including the steps of applying an electrical energy to electrodes within a printer head; creating different-density electric fields between the electrodes; letting pigment particles of an ink migrate into high density one of the electric fields; and letting the migrating pigment particles be transferred onto print media for printing. The inventive ink-jet printing apparatus includes a plurality of electrodes electrically isolated from each other so as to create electric fields different in density within a plurality of nozzles; first supports having orifices and supporting the electrodes; a plurality of electrode layers supplying electrical energy and connecting the electrodes to each other; a second support formed between an ink storage vessel and the electrode layers, and supporting the electrode layers; and electrically-connecting means for furnishing electrical energy to the electrode layers.

32 Claims, 9 Drawing Sheets

INK-JET PRINTING METHOD AND INK-JET PRINTING APPARATUS USING DIELECTRIC MIGRATION FORCE

CLAIM OF PRIORITY

This application makes reference to, incorporates the same herein, and claims all benefits accruing under 35 U.S.C. §119 from an application for INK-JET PRINTING METHOD AND INK-JET PRINTING APPARATUS USING DIELECTRIC MIGRATION FORCE earlier filed in the Korean Industrial Property Office on the $16^{th}$ of October 1996 and there duly assigned Ser. No. 46260/1996.

FIELD OF THE INVENTION

The present invention relates to a spray device for an ink-jet printer.

DISCUSSION OF RELATED ART

In a general inkjet printhead, the head includes a resistor layer formed on a silicon dioxide ($SiO_2$) layer on a silicon substrate and heated by electrical energy; a pair of electrodes formed on the resistor layer and thus providing it with electrical energy; a protective layer formed on the pair of electrodes and on the resistor layer, for preventing a heating portion from being etched/damaged by a chemical reaction to the ink; an ink chamber for generating bubbles by the heat from the heating portion; an ink barrier acting as a wall defining the space for flowing the ink into the ink chamber; and a nozzle plate having an opening for spraying the ink pushed out by a volume variation, i.e., the bubbles, in the ink chamber.

Here, the nozzle plate and the heating portion oppose each other with a regular spacing. The pair of electrodes are electrically connected to a terminal which is in turn connected to the head controller, so that the ink is sprayed from each nozzle opening.

The thus-structured conventional ink spraying device operates as follows. A head driver transmits electrical energy to the pair of electrodes positioned where the desired dots are to be printed, according to the printing control command received through the printer interface from a CPU. This power is transmitted for a predetermined time through the selected pair of electrodes and heats the heating portion by electrical resistance heating (measured in joules) as determined by $P=I^2R$. The heating portion is heated to 500° C.–550° C., and the heat conducts to the protective layer thereon. Here, when the heat is applied to the ink directly wetting the protective layer, the distribution of the bubbles generated by the resulting steam pressure is highest in the center of the heating portion and symmetrically distributed. The ink is thereby heated and bubbles are formed, so that the volume of the ink on the heating portion is changed by the generated bubbles. The ink pushed out by the volume variation is expelled through the opening of the nozzle plate.

At this time, if the electrical energy supply to the electrodes is cut off, the heating portion is momentarily cooled and the expanded bubbles are accordingly contracted, thereby returning the ink to its original state.

The ink thus expanded and discharged out through the openings of the nozzle plate is sprayed into the printing media in the form of a drop, forming an image thereon due to surface tension. In doing so, internal pressure is decreased in accordance with the volume of the corresponding bubbles discharged, which causes the ink chamber to refill with ink from the container through the ink via.

However, the above mentioned conventional ink spraying device has several problems. First, since bubbles are formed in the ink by high-temperature heating and the ink itself exhibits a thermal variation, the lifetime of the head is decreased due to an impact wave from the bubbles. Second, the ink and the protective layer react electrically with each other, resulting in corrosion due to migrating ions from the interface of the heating portion and the electrodes, which thereby further decreases the lifetime of the head. Third, the influence of bubbles being formed in the ink chamber containing ink increases the ink chamber's recharging time. Fourth, the shape of the bubbles affects the advance, circularity and uniformity of the ink drop, which therefore affects printing quality.

An improved spraying device contrived to solve these problems is described in U.S. Pat. Ser. No. 08/884,489 entitled "Spray Device for Ink-Jet Printer and a Method Thereof" by Ahn Byung-sun. In this technique, a single-layer membrane made of a uniform material having a high heat-conductivity, e.g., Ag, Al, Cd, Cs, K, Li, Mg, Mn, Na or Zn. Thus, though the upper portion of the membrane (that in contact with the ink chamber) and the lower portion of the membrane (that in contact with the heating chamber) have identical coefficients of thermal expansion, they have different thermal expansion rates due their adjacent materials, leaving the upper portion at a lower temperature and with a slower rate of volume variation. Therefore, the upper portion of the membrane tends to open in fissures. Also, since there is no difference of the contracting rate with respect to the heat variation between the upper and lower portions of the membrane, the suction force of ink from the ink via to the ink chamber through the ink channel is small. Consequently, after expansion, it takes a long time for the ink to return to its original state, which affects the ink supplying speed and thus slows the overall printing speed.

U.S. Pat. No. 4,801,955 discloses an Ink Jet Printer to Miura et al. The printer contains electrodes near the opening of the nozzle to help expel the ink. However I have not found that an electric field gradient is set up to help eject the ink from the nozzle. In addition, I have not seen electrodes placed along sloped interior sidewalls of a nozzle to help eject ink.

SUMMARY OF THE INVENTION

Accordingly, the present invention is directed to an ink-jet printing method and an ink-jet printing apparatus that substantially obviate one or more of the problems due to limitations and disadvantages of the related art.

It is a first object of the present invention to provide an ink-jet printing method which applies electrical energies, different from each other in intensity, across electrodes so as to make a difference in electric field density between the electrodes, and thus lets pigment particles of ink migrate and be transferred onto print media to form characters thereon, without using a nozzle plate.

It is a second object of the present invention to provide an ink-jet printing method and an ink-jet printing apparatus which does not need high-level clean work conditions for the manufacture of an ink cartridge's head and operating conditions of an ink spraying device that can sensitively cope with a thermal change and can perform printing without using any heating device and multi-layered protective portion.

Additional features and advantages of the invention will be set forth in the description which follows, and in part will be apparent from the description, or may be learned by practice of the invention. The objectives and other advantages of the invention will be realized and attained by the structure particularly pointed out in the written description and claims hereof as well as the appended drawings.

To achieve these and other advantages and in accordance with the purpose of the present invention, as embodied and broadly described, there is disclosed an ink-jet printing method including the steps of applying an electrical energy to electrodes within a printer head; creating different-density electric fields between the electrodes; letting pigment particles of an ink migrate into high density one of the electric fields; and letting the migrating pigment particles be transferred onto print media for printing.

According to another aspect of the present invention, an ink-jet printing apparatus includes a plurality of electrodes spaced a given distance away from one another to be electrically isolated from each other so as to create electric fields different in density within a plurality of nozzles; first supports having a plurality of orifices and supporting the electrodes; a plurality of electrode layers supplying electrical energy and connecting the electrodes to each other; a second support formed between an ink storage vessel and the electrode layers to constitute an ink chamber, supporting the electrode layers, and used for uniformity of electric field density; and electrically-connecting means for furnishing electrical energy to the electrode layers, wherein if supplying the electrical energy to the electrodes formed within the nozzles through the electrode layers, electric fields different in density are linearly created toward the orifices, and pigment particles of an ink migrate into a high-density one of the electric fields, thus jetting out on print media.

BRIEF DESCRIPTION OF THE ATTACHED DRAWINGS

A more complete appreciation of the invention, and many of the attendant advantages thereof, will be readily apparent as the same becomes better understood by reference to the following detailed description when considered in conjunction with the accompanying drawings in which like reference symbols indicate the same or similar components, wherein.

Figure 13:
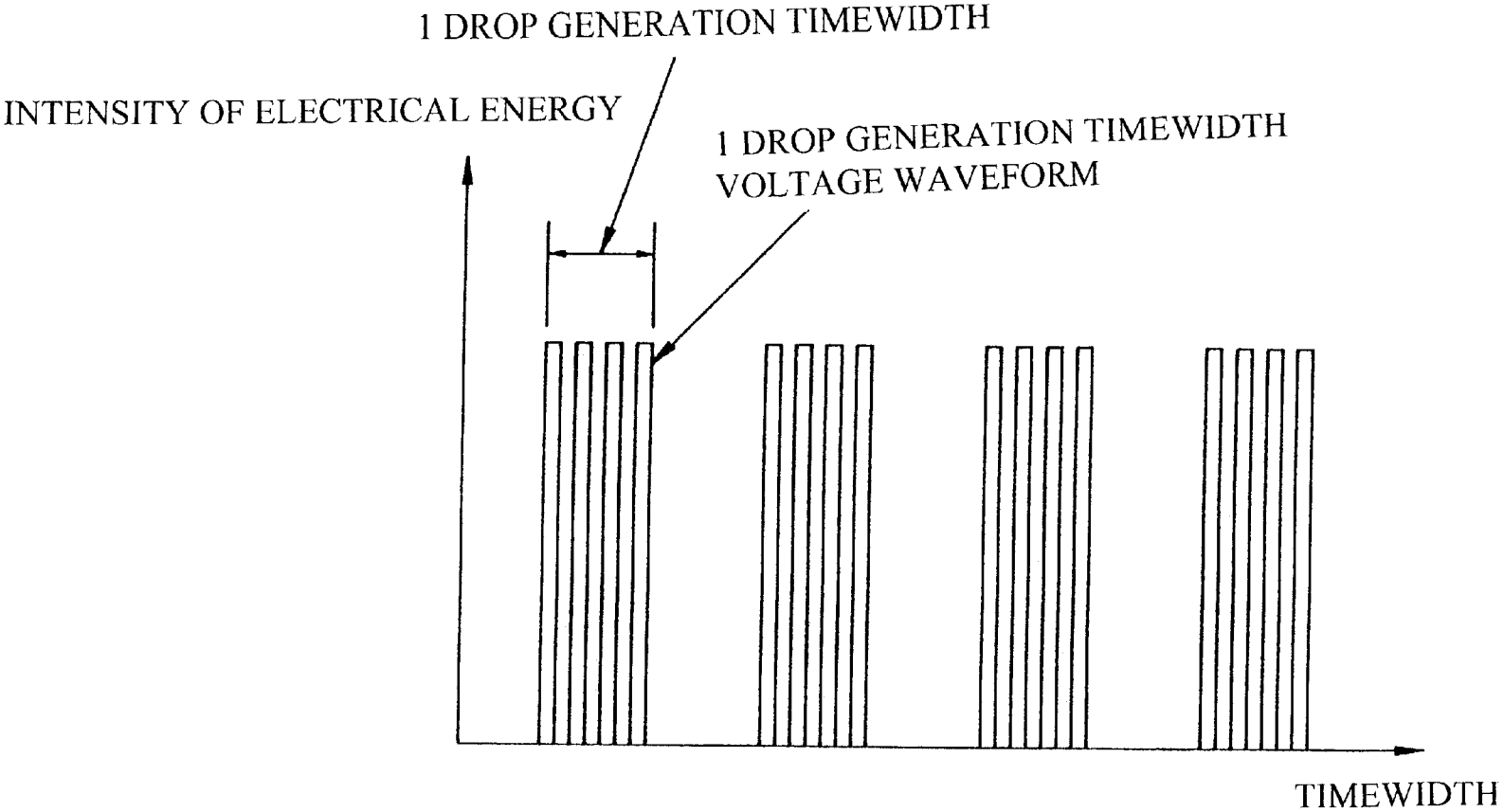

FIGS. 9 to 12 each depict the operating condition in accordance with the present invention; and FIG. 13 is a waveform chart showing the relation of time and voltage applied to electrode layers.

DETAILED DESCRIPTION OF THE INVENTION

Figure 1:
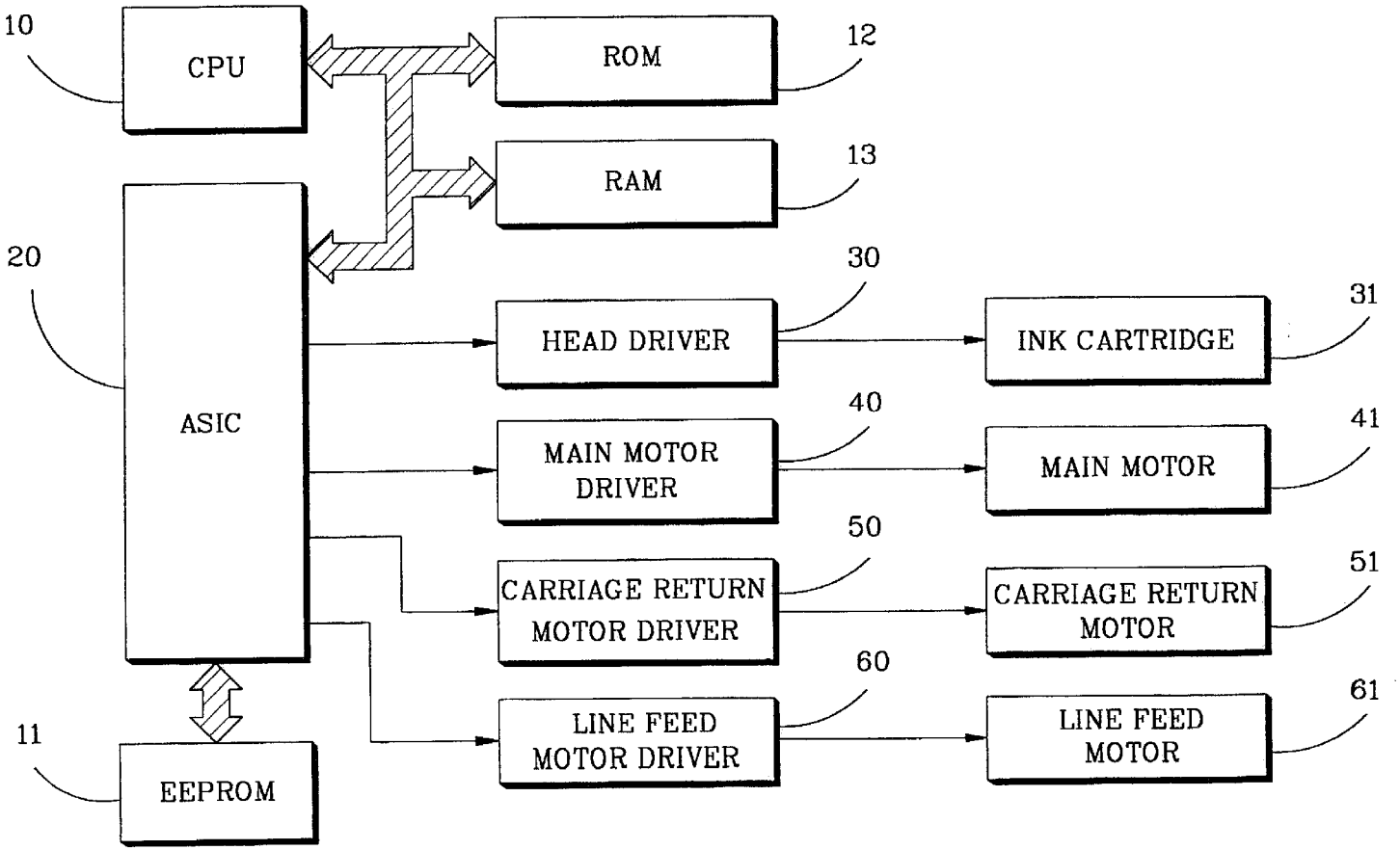
FIG. 1 is a block diagram of a conventional ink-jet printing apparatus.

The structure and operational principle of a general ink-jet printer will be described below with reference to FIG. 1. An ink-jet printer has a CPU 10 for receiving a signal from a host computer (not shown) through its printer interface, reading a system program in an EPROM 11 that stores initial values for operating the printer and the overall system, analyzing the stored values, and outputting control signals according to the content of the program; a ROM 12 for storing a control program and several fonts; a RAM 13 for temporarily storing data during system operation; an ASIC circuit 20, which comprises most of the CPU-controlling logic circuitry, for transmitting data from the CPU 10 to the various peripheral components; a head driver 30 for controlling the operation of an ink cartridge 31 according to the control signals of the CPU 10 transmitted from the ASIC circuit 20; a main motor driver 40 for driving a main motor 41 and for preventing the nozzle of the ink cartridge 31 from exposure to air; a carriage return motor driver 50 for controlling the operation of a carriage return motor 51; and a line feed motor driver 60 for controlling the operation of a line feed motor 61 which is a stepping motor for feeding/discharging paper.

In the operation of the above apparatus, a printing signal from the host computer is applied through the printer interface thereof, to drive each of the motors 41, 51 and 61 according to the control signal of the CPU 10 and thus perform printing. Here, the ink cartridge 31 forms dots by spraying fine ink drops through a plurality of openings in its nozzle.

Figure 3:
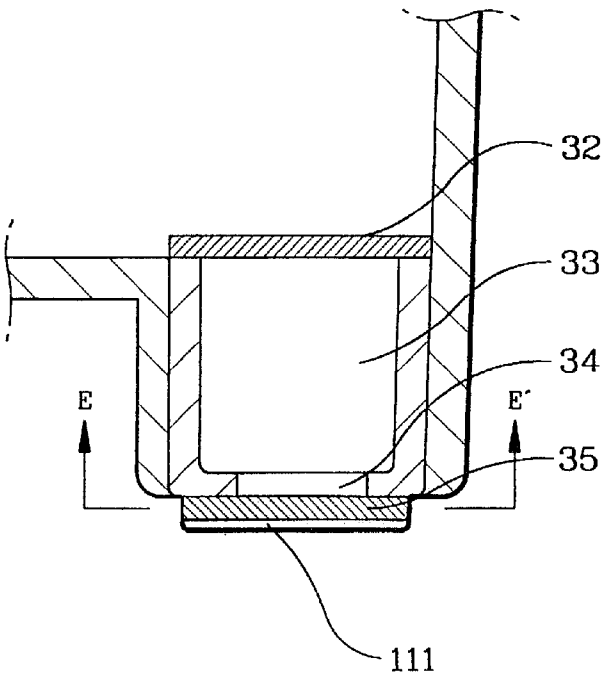
FIG. 3 is an enlarged-sectional view of a head of FIG. 2.
Figure 2:
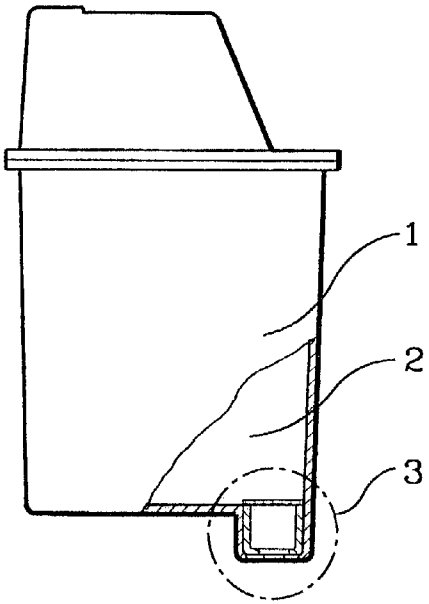
FIG. 2 is a sectional view of an ink cartridge of the conventional ink-jet printing apparatus.

The ink cartridge 31, shown FIG. 2, comprises a case 1, which forms the external profile of the cartridge, for housing a sponge-filled interior 2 for retaining the ink. Also included in the ink cartridge 31 is a head 3, shown in detail in FIG. 3, which has a filter 32 for removing impurities in the ink; an ink stand pipe chamber 33 for containing the filtered ink; an ink via 34 for supplying ink transmitted through the ink stand pipe chamber 33 to an ink chamber (see FIG. 5) of a chip 35; and a nozzle plate 111 having a plurality of openings, for spraying ink in the ink chamber transmitted from the ink via 34 onto printing media (e.g., a sheet of paper).

Figure 4:
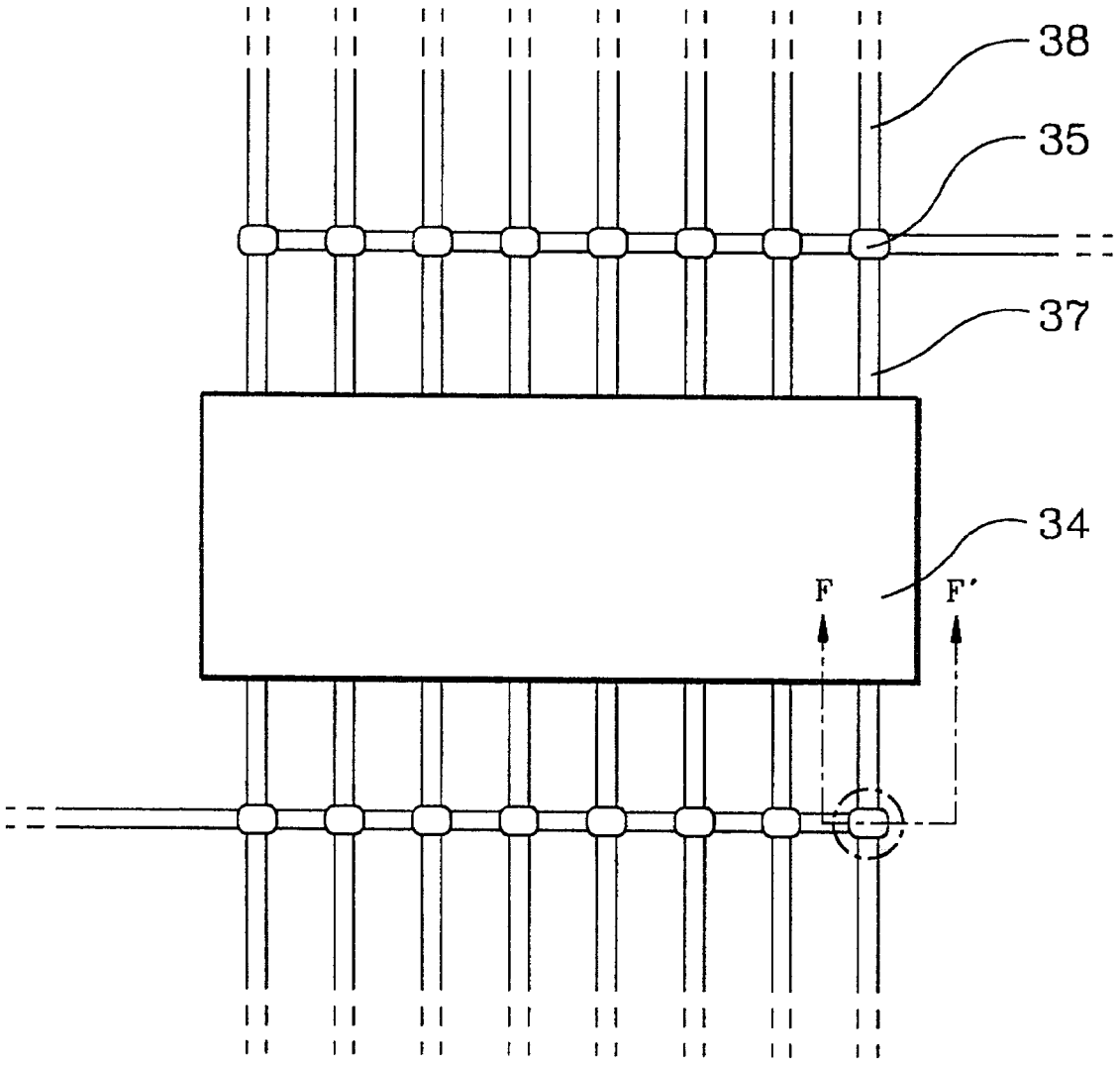
FIG. 4 is a sectional view as taken along line E—E of FIG. 3 and shown from A.

As illustrated in FIG. 4, besides the ink via 34, the head 3 includes a plurality of ink channels 37 for supplying ink from the ink via to each opening of the nozzle plate 111; a plurality of nozzles 110 for spraying ink transmitted through the ink channels 37; and a plurality of electrical connections 38 for supplying power to the chip 35.

Figure 5:
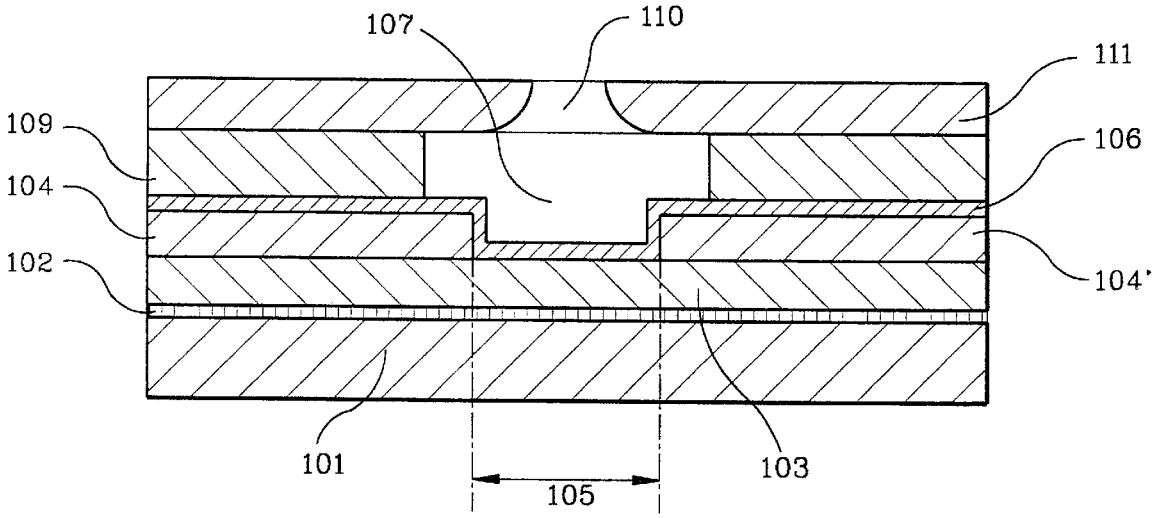
FIG. 5 is an enlarged-sectional view as taken along line F—F of FIG. 4 and shown from B.

As illustrated in FIG. 5, the head 3 includes a resistor layer 103 formed on a silicon dioxide ($SiO_2$) layer 102 on a silicon substrate 101 and heated by electrical energy; a pair of electrodes 104 and 104' formed on the resistor layer 103 and thus providing it with electrical energy; a protective layer 106 formed on the pair of electrodes 104 and 104' and on the resistor layer 103, for preventing a heating portion 105 from being etched/damaged by a chemical reaction to the ink; an ink chamber 107 for generating bubbles by the heat from the heating portion 105; an ink barrier 109 acting as a wall defining the space for flowing the ink into the ink chamber 107; and a nozzle plate 111 having an opening 110 for spraying the ink pushed out by a volume variation, i.e., the bubbles, in the ink chamber 107.

Here, the nozzle plate 111 and the heating portion 105 oppose each other with a regular spacing. The pair of electrodes 104 and 104' are electrically connected to a terminal (not shown) which is in turn connected to the head controller (FIG. 1), so that the ink is sprayed from each nozzle opening.

Figure 6:
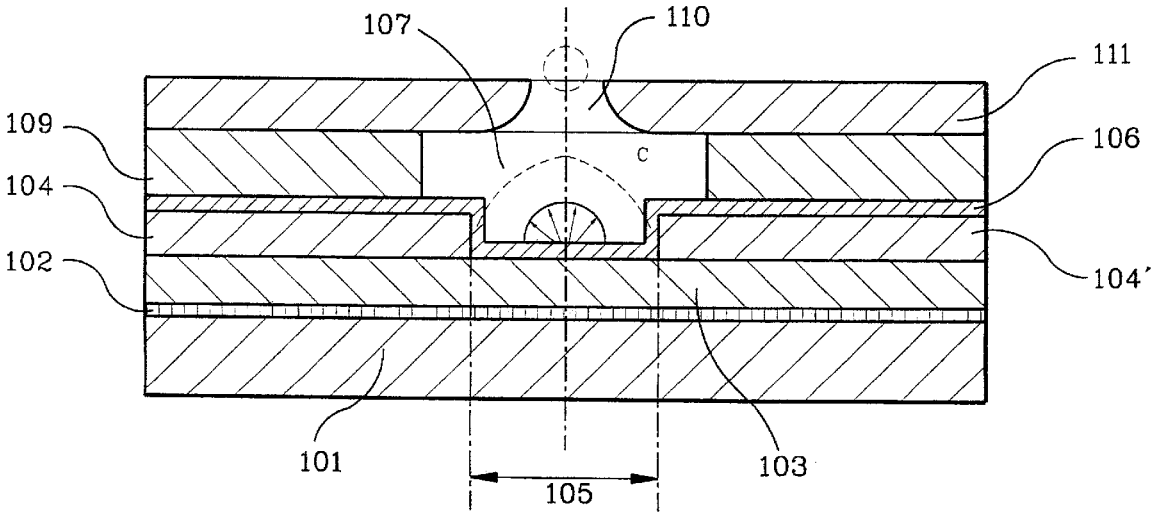
FIG. 6 depicts a conventional ink spraying mechanism.

The thus-structured conventional ink spraying device operates as follows. The head driver 30 transmits electrical energy to the pair of electrodes 104 and 104' positioned where the desired dots are to be printed, according to the printing control command received through the printer interface from the CPU 10. This power is transmitted for a predetermined time through the selected pair of electrodes 104 and 104' and heats the heating portion 105 by electrical resistance heating (measured in joules) as determined by $P=I^2R$. The heating portion 105 is heated to 500° C.–550° C. and the heat conducts to the protective layer 106 thereon. Here, when the heat is applied to the ink directly wetting the protective layer, the distribution of the bubbles generated by the resulting steam pressure is highest in the center of the heating portion 105 and symmetrically distributed (see FIG. 6). The ink is thereby heated and bubbles are formed, so that the volume of the ink on the heating portion 105 is changed by the generated bubbles. The ink pushed out by the volume variation is expelled through the opening 110 of the nozzle plate 111.

At this time, if the electrical energy supply to the electrodes 104 and 104' is cut off, the heating portion 105 is momentarily cooled and the expanded bubbles are accordingly contracted, thereby returning the ink to its original state.

The ink thus expanded and discharged out through the openings of the nozzle plate is sprayed into the printing media in the form of a drop, forming an image thereon due to surface tension. In doing so, internal pressure is decreased in accordance with the volume of the corresponding bubbles discharged, which causes the ink chamber to refill with ink from the container through the ink via.

However, the above-mentioned conventional ink spraying device has several problems. First, since bubbles are formed in the ink by high-temperature heating and the ink itself exhibits a thermal variation, the lifetime of the head is decreased due to an impact wave from the bubbles. Second, the ink and the protective layer 106 react electrically with each other, resulting in corrosion due to migrating ions from the interface of the heating portion 105 and the electrodes 104 and 104', which thereby further decreases the lifetime of the head. Third, the influence of bubbles being formed in the ink chamber containing ink increases the ink chamber's recharging time. Fourth, the shape of the bubbles affects the advance, circularity and uniformity of the ink drop, which therefore affects printing quality.

Figure 7:
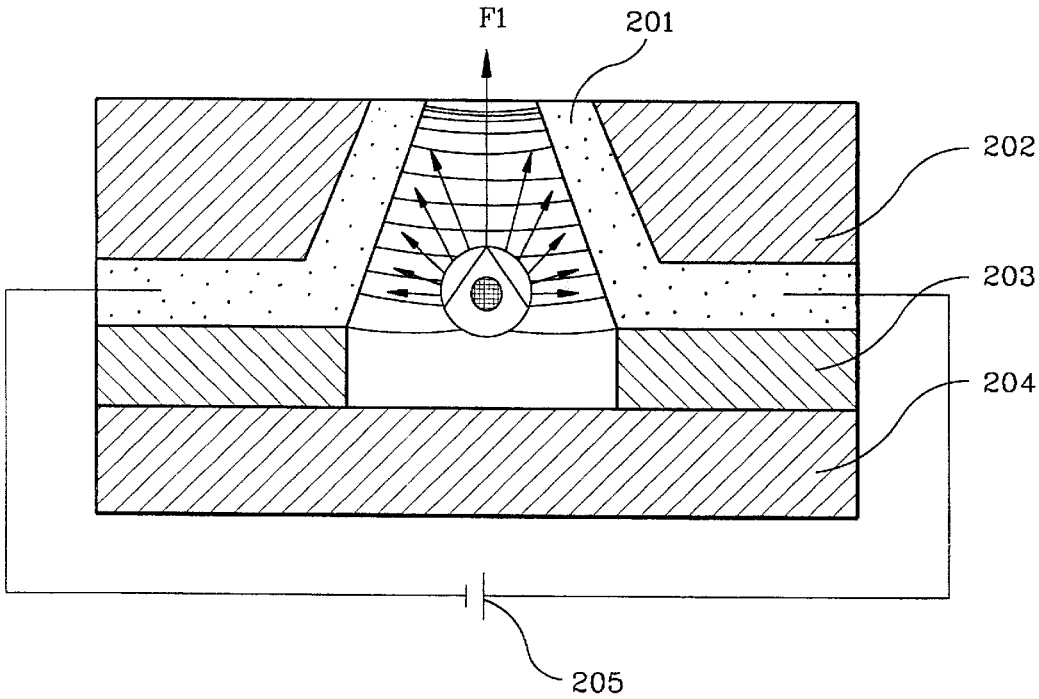
FIG. 7 is an enlarged-sectional view of a head of an ink-jet printing apparatus in accordance with the present invention.

FIG. 7 depicts an ink-jet printing apparatus in accordance with the present invention, and is an enlarged-sectional view of a head of the inventive ink-jet printing apparatus. The head includes a plurality of electrodes 201 inside a nozzle which each have a semi-conic section and a paper-contacting part with a diameter smaller than an inner diameter on the part of an ink chamber to make a difference in electric field density between electrodes 201 by applying different electrical energies thereto, and are electrically isolated from each other, first supports 202 each sustaining electrodes 201, a plurality of electrode layers 203 furnishing electrical energy to electrodes 201 and connecting them to one another, a second support 204 made of an insulating material for uniformity of electric field density, supporting electrode layers 203, and forming an ink chamber between itself and an ink storage vessel, and an electrically connecting means used for furnishing electrical energy to electrode layers 203, and an electrically connecting means 205 for furnishing electrical energy to the electrode layers 203.

The electric field density at the paper-contacting part of electrodes 201 is higher than that of the other part near the ink chamber, and the diameter of the paper-contacting part is about ϕ 20 μm to ϕ 40 μm. The diameter of the other part near the ink chamber is ϕ 40 μm to ϕ 130 μm. A polarization force (a), created by electric field density which varies with electrical energy applied to electrodes 201, acts on pigment particles inside of electrodes 201, and a dielectric migration force F1, the resultant of polarization forces, works in the direction of paper transfer. A coulomb force acts in the horizontal direction of electrode layers 203.

Figure 8:
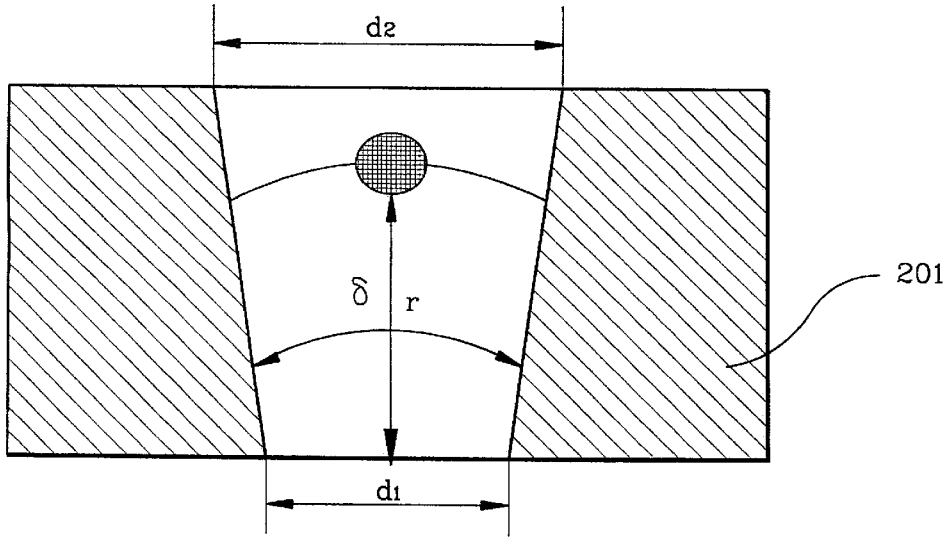
FIG. 8 is an enlarged-sectional view of a nozzle of FIG. 7.

FIG. 8 is an enlarged-sectional view of a nozzle of FIG. 7, and reference numerals denote the following reference parts: d a distance between electrodes 201 at a certain pigment particle; d1 a diameter of each of orifices positioned in the ink-spraying direction; d2 a distance between two electrodes of an internal power supply part, an ink storage vessel; r a distance between the pigment particle and one orifice; and δ an angle of inclination between two electrodes.

Figure 9:
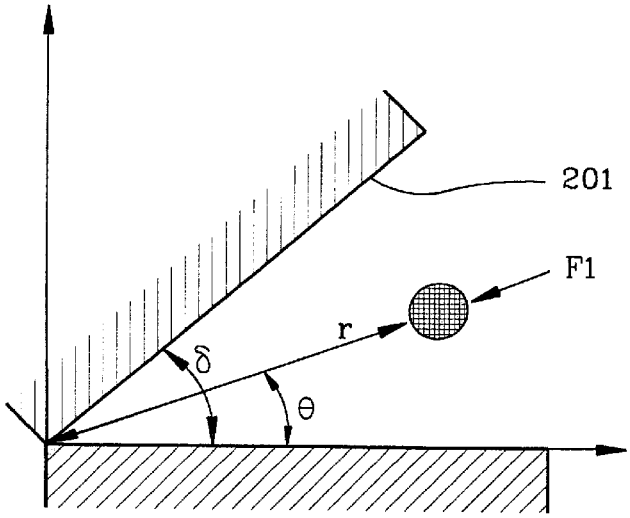

FIG. 9 depicts the nozzle viewed from a different direction for more detailed description. The size δ of FIG. 8 is larger than the angle θ of the pigment particle and electrodes, and r equals $$\frac{d}{2\tan(\delta/2)}.$$

Figure 10:
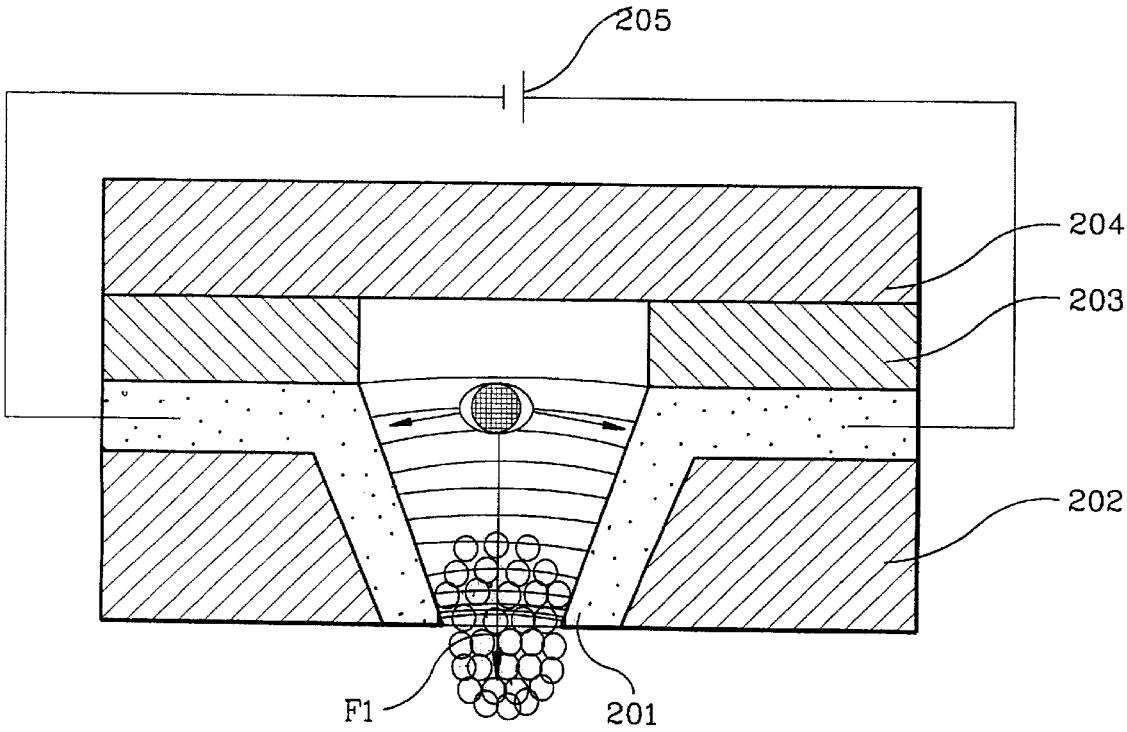
Figure 11:
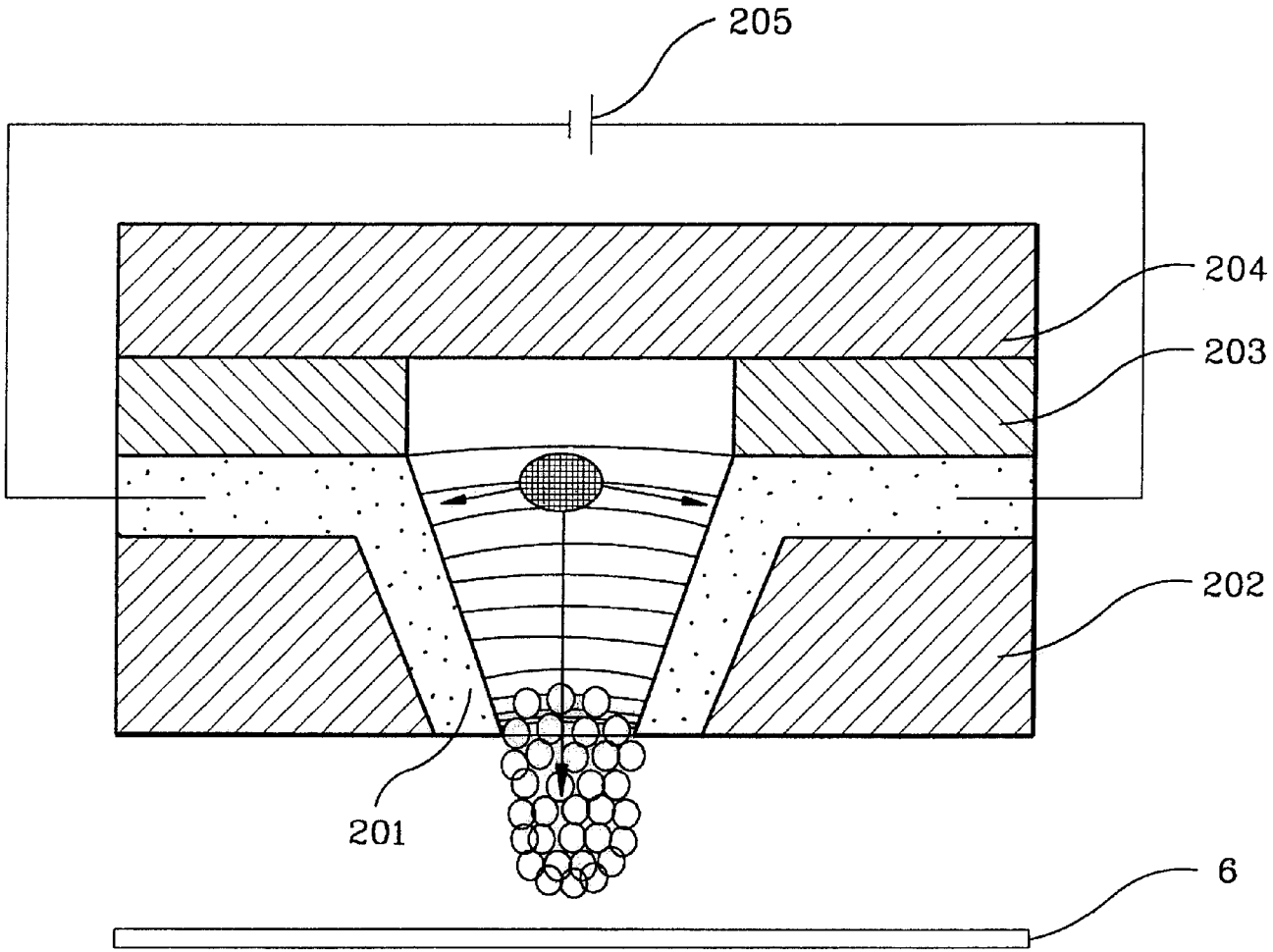
Figure 12:
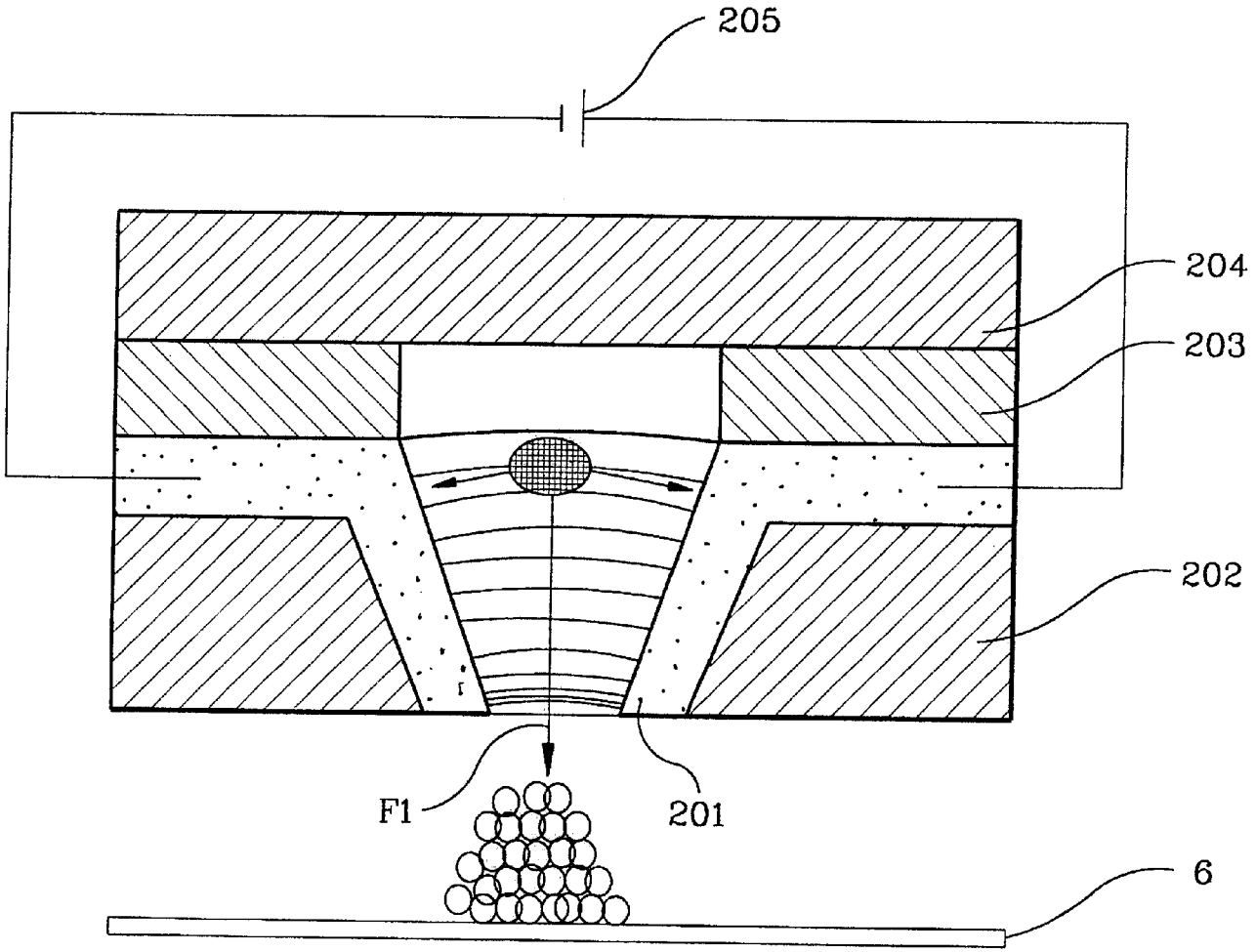

FIGS. 9 to 11 depict the steps in the generation of ink drops that are jetting out by dielectric migration force F1, the resultant of polarization forces produced by different electric field densities between electrodes 201.

Referring first to FIG. 9, the electrical energy, furnished by the electrically connecting means, is transferred to each electrode 201 through electrode layers 203, and the electric field density of electrodes 201 becomes different by regions. Since electrode 201's region near the paper has a higher electric field density than that of electrode 201's the other region adjacent to the ink chamber, pigment particles contained in the ink are moved to the orifices by the dielectric migration force.

The above mechanism will be more fully described.

Once the electrical energy is applied to two electrodes 201, an electric field is created between two electrodes, and orifices of the nozzles with a small diameter have a high electric field density. The other orifices of the nozzles with a large diameter have a low electric field density. The polarization within each pigment particle concentrates on the high-density electric field, and the coulomb force is parallel distributed. The resultant of polarization forces is made at the region where the high density electric field is created, thus moving to the orifices. The resultant of polarization forces is called "dielectric migration force" (F1), and causes the migration of pigments. The dielectric migration force is an interaction of polarized charges of pigment particles interposed between two electrodes 201 that are out of balance in electric field and the unbalanced electric fields. Generally, the dielectric migration force is expressed as $$\frac{1}{2}\alpha\nu E^2,$$

wherein the reference letters denote the followings:

α induced polarization; ν volume of a body; and E electric field. That is, the dielectric migration force relates to the generation of a sucking force on the subject particles at the high-density electric field.

Each pigment particle that does not contact electrodes 201, migrates into the middle of two electrodes 201, and a speed at which each pigment particle migrates is expressed as:

$$v = \frac{\alpha v v_0^2}{6\pi\eta a} \cdot \frac{1}{\delta^2 r^3} = \frac{4\alpha v v_0^2}{3\pi\eta a} = \frac{\tan\frac{3\delta}{2}}{\delta^2} \cdot \frac{1}{d^3}$$

$\alpha$ induced polarization; v volume of a body; $\eta$ liquid viscosity; a diameter of the particle; $V_0$ applied voltage; $\delta$ angle of an intersection of two electrodes 201; d distance between two electrodes 201 at each particle; r distance from the orifice to a certain particle; and E electric field.

$$|E| \text{ equals } \frac{v_0}{r\delta}.$$

The higher the ratio of $$\frac{d_2}{d_1},$$

the ratio of a gap between two electrodes 201 is, the higher the migrating speed of the pigment particles becomes. The angle of an intersection of two electrodes 201, $\delta$ is in the range of 30° to 60°.

As shown in FIG. 10, the pigment particles concentrate on an orifice with a diameter of $\phi$ 20 $\mu$m to $\phi$ 40 $\mu$m, and spherical lumps of pigment are generated by the migration of the pigment particles. If each lump of pigment is larger than the surface tension acting on the orifices, it is moved in a direction perpendicular to the print media. At this point, the dielectric migration force, outside force, the dead weight are applied to the lumps of pigment.

FIG. 11 depicts separation of the lumps of pigment from the orifices of the nozzles for printing on print media. If the electrical energy stops being furnished to electrodes 201 through electrode layers 203, the polarization force and coulomb force acting on the pigment are lost. The lumps of pigment cannot enter the ink chamber inside of the orifices by the liquid. The dead weight is applied to the pigment, and as the surface tension becomes weak, the pigment is sprayed on the print media. Each orifice instantaneously becomes in the shape of a meniscus according to repulsive power produced by separation of the lumps of pigment, along with negative pressure, and then returns to its original shape by the ink supply from the ink storage vessel.

FIG. 13 is a waveform chart showing the relation of time and voltage applied to the electrode layers, and as shown in FIG. 13, a plurality of pulses exist in a period of time for producing an ink drop.

The present invention is more advantageous when operating it with a high frequency of maximum 1 MHz and below in a period of time of frequency for production of an ink drop in order to prevent the electrode reaction due to the electrolysis of media. Printing on print media is carried out by repeating the above steps. Thus, present invention does not need any heating device for heating the ink and producing steam pressure or piezo-electric device such as an oscillating plate for changing the volume of the ink. While the conventional ink-jet printing method requires the heat-resistance of ink as the ink is heated, the present invention employs the dielectric migration force, thus making it easy to select ink to be used, and spraying lumps of pigment and a small amount of liquid on print media to make the ink on the print media be dried rapidly. The present invention precludes damage to internal components of the ink-jet printing apparatus due to the straightfowardness of the ink and shock waves made by the use of the ink spraying device, thus making the life of the apparatus longer. In addition, the present invention uses the electrodes for jetting the ink out without any extra nozzle plate, which simplifies the ink-jet printing apparatus in construction, and does not need the high-level clean work conditions, thereby having an advantageous yield aspect.

It will be apparent to those skilled in the art that various modifications and variations can be made in the ink-jet printing apparatus and ink-jet printing method of the present invention without departing from the spirit or scope of the invention. Thus, it is intended that the present invention cover the modifications and variations of this invention provided they come within the scope of the appended claims and their equivalents.

What is claimed is:

1. An ink-jet printing method, comprising the steps of:

applying electrical energy to a plurality of electrodes within a printhead comprising a plurality of nozzles to establish a gradient of electric fields having different densities between the electrodes varying from a low density electric field at regions away from said nozzles to a high density electric field at orifices of said nozzles; and permitting pigment particles of an ink to migrate into said orifices of said nozzles of said high density electric field and ejecting said pigment particles of an ink onto a print medium for printing.

2. The ink-jet printing method of claim 1, said permitting step further comprising:

using an ink containing pigment particles having a specified dielectric constant.

3. The ink-jet printing method of claim 1, said step of applying electrical energy further comprising:

at least two of said adjacent electrodes being formed to slope by a predetermined angle, causing a distance between the electrodes to vary linearly with the distance from an orifice.

4. The ink-jet printing method of claim 3, said step of applying electrical energy further comprising:

the distance between the two electrodes near each orifice being smaller than the distance between the two electrodes at regions further from the orifice within an ink chamber so as to spray the ink of pigment particles on the print medium.

5. The ink-jet printing method of claim 3, said step of applying electrical energy further comprising:

the sloped electrodes being formed within each nozzle.

6. An ink-jet printing apparatus, comprising:

a plurality of electrodes within a plurality of nozzles, said electrodes spaced apart by a given distance and electrically isolated firm each other to create an electric field gradient within the plurality of nozzles;

first supports having a plurality of orifices and supporting said electrodes;

a plurality of electrode layers supplying electrical energy and a means for connecting said electrodes to each other;

a second support formed between an ink storage vessel and the electrode layers to constitute an ink chamber, supporting the electrode layers, and used for uniformity of electric field density;

electrically-connecting means for furnishing electrical energy to said electrode layers, wherein if supplying the electrical energy to the electrodes formed within the nozzles through the electrode layers, electric fields are most intense near the orifices, and vary linearly away from the orifices in the direction of the ink chamber, and pigment particles of an ink migrate into said most intense electric field, thus jetting out on print media.

7. An ink-jet printing apparatus according to claim 6, wherein said ink consists of pigment particles and a liquid, serving as a carrier.

8. An ink-jet printing apparatus according to claim 6, wherein said electrodes are each formed to slope by a predetermined angle, causing the distance between the electrodes to vary linearly with distance from an orifice.

9. An ink-jet printing apparatus according to claim 8, wherein the distance between the two electrodes near the orifice is smaller than the distance between the regions of the two electrodes further from the orifice within the ink chamber, so as to spray the ink of pigment particles onto the print media.

10. An ink-jet printing apparatus according to claim 8, wherein each of said plurality of electrodes are formed within the plurality of nozzles.

11. An ink-jet printing apparatus according to claim 6, wherein each one of said plurality of orifices contains two electrodes that are electrically isolated from each other.

12. An ink-jet printing apparatus according to claim 6, wherein the electrical energy applied across the electrode layers is a direct-current voltage.

13. An ink-jet printing apparatus according to claim 6, wherein the electrical energy applied across the electrode layers is an alternating-current voltage.

14. An ink-jet printing apparatus according to claim 6, wherein the electrical energy applied across the electrode layers is electrically controlled by a high frequency voltage with a plurality of pulse widths in a period of time.

15. An ink-jet printing apparatus according to claim 14, wherein the high frequency for generating one ink drop is no more than 1 MHz.

16. An ink-jet printing apparatus according to claim 6, wherein the ink chamber is formed by the second support and a plurality of electrode layers and connected to the ink storage vessel.

17. An ink-jet printing apparatus according to claim 6, wherein the diameter of each orifice in the region away from the ink chamber is 20 $\mu$m to 40 $\mu$m.

18. An ink-jet printing apparatus according to claim 6, wherein the diameter of each orifice in the region inside the ink chamber is 40 $\mu$m to 130 $\mu$m.

19. An ink-jet printing apparatus according to claim 6, wherein the first supports and second support are made of insulating layers.

20. An ink-jet printing apparatus according to claim 6, wherein an angle between a pair of electrodes is in the range of 30° to 60°.

21. A printhead cartridge, comprising:

an ink container for containing ink;

a printhead comprising an array of nozzles arranged vertically at a distal end, and a plurality of heating elements for heating and discharging ink from the ink container through an ejection orifice of corresponding nozzles to print data information on a print medium, each nozzle comprising a plurality of spaced-apart and electrically isolated electrodes for creating different density electric fields from a low density electric field at regions in proximity of said ink container to a high density electric field at said ejection orifice in proximity of said print medium in response to application of electrical energy, and letting pigment particles of said ink to migrate into said ejection orifice of said high density electric field for ejection onto said print medium during a print operation.

22. The printhead cartridge of claim 21, wherein said ink contains said pigment particles exhibiting a specified dielectric constant.

23. The printhead cartridge of claim 21, wherein adjacent electrodes are inclined toward said ejection orifice at a predetermined angle of approximately 30° to 60°, causing a distance between the electrodes to vary linearly with the distance from said ejection orifice.

24. The printhead cartridge of claim 23, wherein a distance between two adjacent electrodes in proximity of said ejection orifice is smaller than the distance between the two adjacent electrodes in proximity of said ink container so as to spray the ink of pigment particles on the print medium.

25. The printhead cartridge of claim 21, wherein said ejection orifice has a minimum diameter of 20 $\mu$m to 40 $\mu$m.

26. The printhead cartridge of claim 21, wherein each nozzle has a maximum diameter of 40 $\mu$m to 130 $\mu$m at a region in proximity of said ink container.

27. A method of ink jet printing, comprising the steps of:

applying an electric field to the inner portion of the nozzle of an ink jet printer, the coulomb force of said electric field acting roughly perpendicular to the axis of the nozzle, and the field increasing in strength from the interior of the nozzle toward the ejection orifice of the nozzle; and turning off the applied electric field at a predetermined time.

28. The method of claim 27, further comprising the step of:

rapidly repeating said steps of applying and turning off the electric field for a predetermined number of times, for the generation of an ink jet printing drop.

29. The method of claim 28, said step of rapidly applying and turning off the electric field being performed with the applied voltage waveform being approximately a square wave.

30. An ink jet printhead, comprising:

a lower support layer made of insulating material, said lower support layer defining a lower portion of an ink chamber;

two supporting electrode layers disposed opposite each other and electrically insulated from each other on the lower support layer, said supporting electrode layers defining an ink chamber between them;

two electrodes, each electrode comprising a portion with the shape of approximately a truncated half cone and each electrode disposed with the larger diameter portion of the half cone on one of the supporting electrode layers, said two electrodes defining the inside of a nozzle of the ink jet printhead; and electrically connecting means for furnishing electrical energy to the electrode layers.

31. The ink jet printhead of claim 30, further comprising:

an upper support disposed around the outside of the half-cone regions of the two electrodes, for sustaining the electrodes.

32. The ink jet printhead of claim 30, further comprising:

controller and power supply means for applying a square waveform through said electrically connecting means to said two electrodes.

* * * * *